US007295162B2

(12) United States Patent
Wang et al.

(10) Patent No.: US 7,295,162 B2
(45) Date of Patent: Nov. 13, 2007

(54) DUAL-FREQUENCY DIRECTIONAL ANTENNA AND HIGH/LOW FREQUENCY RATIO ADJUSTING METHOD THEREOF

(75) Inventors: Wei-Jen Wang, Miao-Li County (TW); Jo-Wang Fu, Miao-Li County (TW)

(73) Assignee: Coretronic Corporation, Miao-Li County (TW)

( * ) Notice: Subject to any disclaimer, the term of this patent is extended or adjusted under 35 U.S.C. 154(b) by 7 days.

(21) Appl. No.: 11/436,224

(22) Filed: May 17, 2006

(65) Prior Publication Data

US 2007/0013585 A1 Jan. 18, 2007

(30) Foreign Application Priority Data

Jul. 13, 2005 (TW) ..... 94123683 A

(51) Int. Cl.
*H01Q 1/38* (2006.01)

(52) U.S. Cl. ..... 343/700 MS; 343/795; 343/893

(58) Field of Classification Search ..... 343/700 MS, 343/795, 893
See application file for complete search history.

(56) References Cited

U.S. PATENT DOCUMENTS 6,037,911 A * 3/2000 Brankovic et al. ..... 343/795
2005/0001777 A1* 1/2005 Suganthan et al. ..... 343/795
2006/0238433 A1* 10/2006 Chou ..... 343/795

OTHER PUBLICATIONS

Faton Tefiku et al, "Design of Broad_Band and Dual-Band antennas Comprised of Series-Fed Printed-Strip Dipole Paris" IEEE Transactions on Antennas and Propagation, vol. 48, No. 6, Jun. 2000, pp. 895-900.

* cited by examiner

*Primary Examiner*—Douglas W. Owens
*Assistant Examiner*—Dieu Hien T Duong
(74) *Attorney, Agent, or Firm*—J.C. Patents

(57) ABSTRACT

A dual-frequency directional antenna includes a dielectric substrate, high frequency antenna elements, low frequency antenna elements, symmetrical micro-strip lines and baluns respectively disposed on a front surface and a rear surface of the dielectric substrate. Two ends of a symmetrical micro-strip line are respectively connected to two low frequency antenna elements. The high frequency antenna elements are disposed between two low frequency antenna elements and connected to a symmetric micro-strip line. Each balun is disposed between two high frequency antenna elements, one end of the balun is connected to a middle segment of a symmetrical micro-strip line and the other end is connected to an antenna feeding port. The dual-frequency directional antenna according to the present invention with thin and compact size has dual operating frequency bands property and is applicable for indoor environment.

20 Claims, 2 Drawing Sheets

DUAL-FREQUENCY DIRECTIONAL ANTENNA AND HIGH/LOW FREQUENCY RATIO ADJUSTING METHOD THEREOF

CROSS-REFERENCE TO RELATED APPLICATION

This application claims the priority benefit of Taiwan application serial no. 94123683, filed on Jul. 13, 2005. All disclosure of the Taiwan application is incorporated herein by reference.

BACKGROUND OF THE INVENTION

1. Field of the Invention

The present invention relates to an antenna, and particularly to a dual-frequency directional antenna.

2. Description of Related Art

Nowadays, following the advancement of integrate circuits, wireless communication apparatuses have been developed to be light and thin. Plane antennas, manufactured with printing circuit method, are highly integrated and advantageous such as easy to be integrated with peripheral elements, thus become the mainstream in the telecommunication market. However, after those conventional antennas being miniaturized, it is inevitable that the frequency bandwidth is narrowed down and the radiation efficiency is reduced, which relatively limits the emitting and receiving of signals, and as a result affects the communication quality. Therefore, how to broaden the operation frequency, satisfy the requirement for multi-frequency signal emitting and receiving and miniaturize the antenna becomes an important issue when designing antennas.

SUMMARY OF THE INVENTION

It is therefore an object of the invention to provide a dual-frequency directional antenna, having two operation frequencies with a thin and compact size and adapted for indoor environment.

It is another object of the invention to provide a method for adjusting the ratio of high/low frequencies received by or emitted from a foregoing dual-frequency directional antenna.

The present invention provides a dual-frequency directional antenna including a dielectric substrate, two first low frequency antenna elements, a first symmetrical micro-strip line, two first high frequency antenna elements, a first balun, two second low frequency antenna elements, a second symmetrical micro-strip line, two second high frequency antenna elements and a second balun. The dielectric substrate includes a front surface and a rear surface. The two first low frequency antenna elements, the first symmetrical micro-strip line, the two first high frequency antenna elements and the first balun are disposed on the front surface. The two second low frequency antenna elements, the second symmetrical micro-strip line, the two second high frequency antenna elements and the second balun are disposed on the rear surface.

Two ends of the first symmetrical micro-strip line are respectively connected with the two first low frequency antenna elements. The two first high frequency antenna elements are disposed between the two first low frequency antenna elements and connected to the first symmetrical micro-strip line. The first balun is disposed between the two first high frequency antenna elements, wherein one end of which is connected to a middle segment of the first symmetrical micro-strip line and another end of which is connected to an antenna feeding port. The first balun and the first high frequency antenna elements are disposed at one side of the first symmetrical micro-strip line, while the first low frequency antenna elements are disposed at the other side of the first symmetrical micro-strip line.

Two ends of the second symmetrical micro-strip line are respectively connected with the two second low frequency antenna elements. The two second high frequency antenna elements are disposed between the two second low frequency antenna elements and connected to the second symmetrical micro-strip line. The second balun is disposed between the two second high frequency antenna elements, wherein one end of which is connected to a middle segment of the second symmetrical micro-strip line and the other end of which is connected to an antenna feeding port. The second balun and the second low frequency antenna elements are disposed at one side of the second symmetrical micro-strip line, while the second high frequency antenna elements are disposed at the other side of the second symmetrical micro-strip line.

In a dual-frequency directional antenna according to the present invention, the widths of the first high frequency antenna elements and the first low frequency antenna elements can be gradually broadened from the side connecting with the first symmetrical micro-strip line toward outside. The widths of the second high frequency antenna elements and the second low frequency antenna elements can be gradually broadened from the side connecting with the second symmetrical micro-strip line toward outside.

The present invention also provides a method for adjusting the ratio of the high/low frequency received by or emitted from the foregoing dual-frequency directional antenna, including: adjusting the linewidth of the part of the first symmetrical micro-strip line between the first low frequency antenna element and the first high frequency antenna element; adjusting the linewidth of the part of the second symmetrical micro-strip line between the second low frequency antenna element and the second high frequency antenna element.

In summary, the dual-frequency directional antenna according to the invention has the advantages such as, having two operation frequencies, being thin and compact size, and being adapted for indoor environment. Further, a larger frequency bandwidth can be obtained by adopting antenna elements whose widths are gradually broadened from the side of the connection with the symmetrical micro-strip line. Furthermore, the ratio of the high/low frequency received or emitted can be adjusted by adjusting the linewidth of the part of the symmetrical micro-strip lines between the low frequency antenna elements and the high frequency antenna elements.

BRIEF DESCRIPTION OF THE DRAWINGS

The features of the invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DESCRIPTION OF THE EMBODIMENTS

Figure 1A:
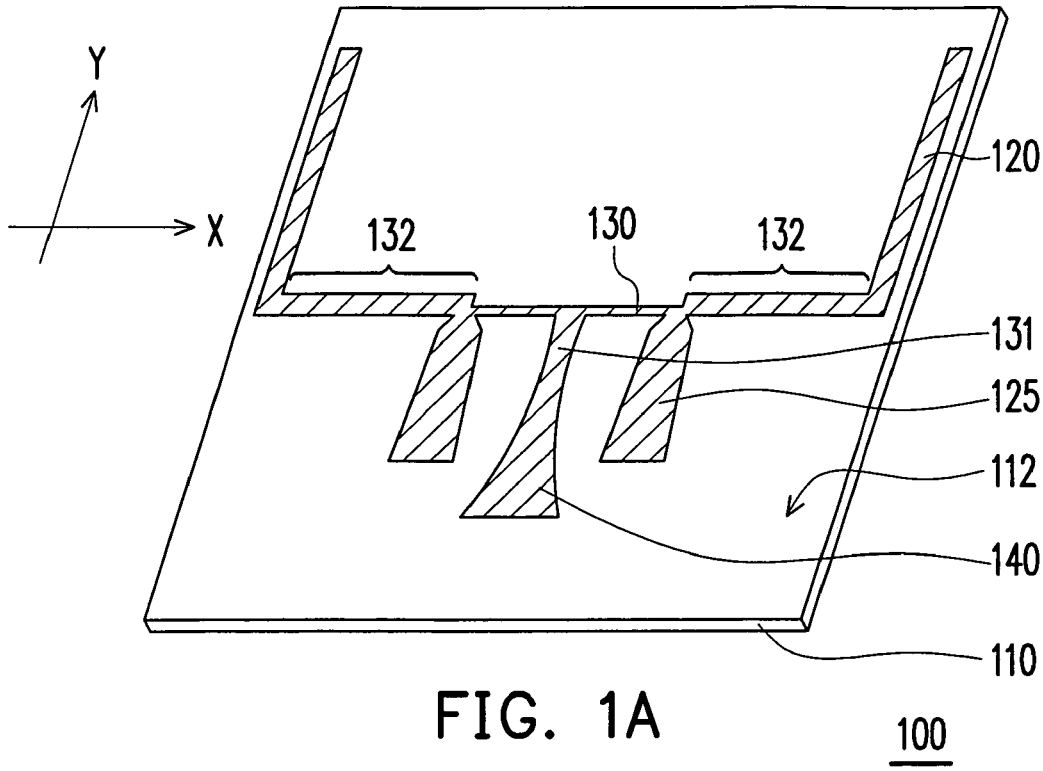
FIGS. 1A and 1B are respectively a front schematic view and a rear schematic view of a dual-frequency directional antenna according to an embodiment of the invention.
Figure 1B:
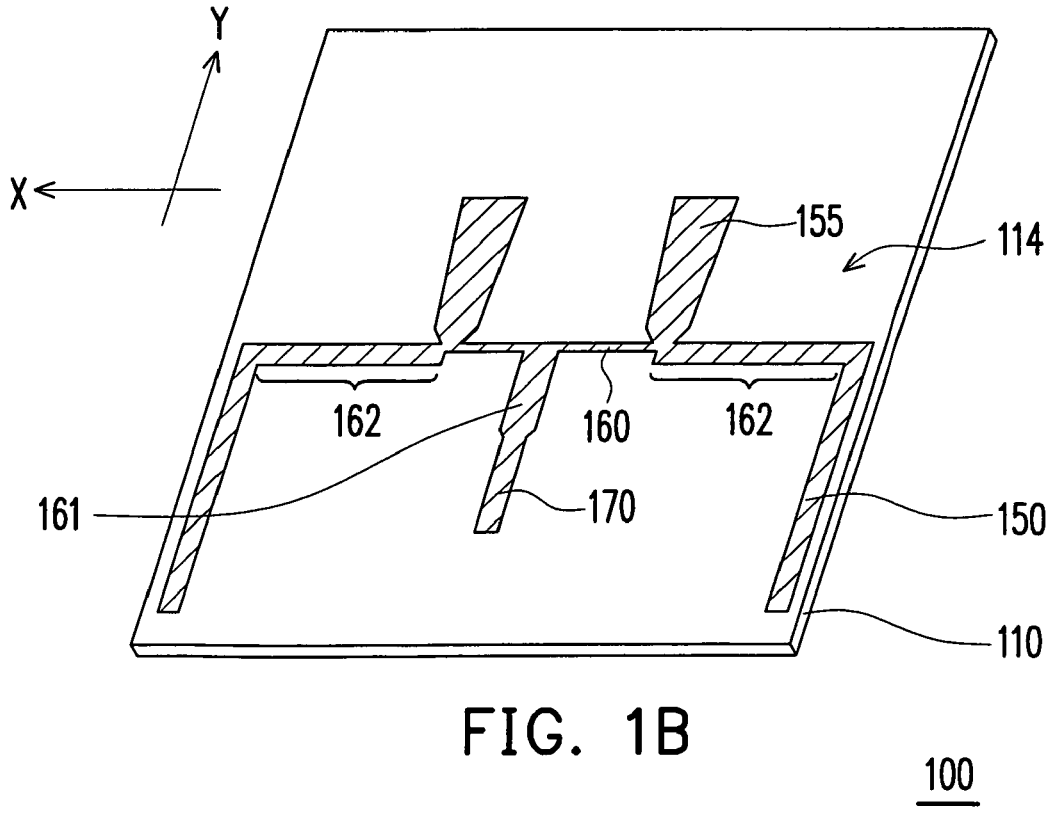

Referring to FIGS. 1A and 1B, a dual-frequency directional antenna 100 according to the embodiment includes a dielectric substrate 110, two first low frequency antenna elements 120, two first high frequency antenna elements 125, a first symmetrical micro-strip line 130, a first balun 140, two second low frequency antenna elements 150, two second high frequency antenna elements 155, a second symmetrical micro-strip line 160 and a second balun 170. The dielectric substrate 110 has a front surface 112 and a rear surface 114. Herein, the dielectric substrate 110 can be one of normal hard substrates for ordinary printed circuit boards or any other dielectric substrate, such as a dielectric substrate composed of glass fiber and epoxy resin. The dielectric substrate 110 is adapted for supporting antenna patterns and electrically insulating the antenna patterns at the front surface 112 from the antenna patterns at the rear surface 114.

The first low frequency antenna elements 120, the first high frequency antenna elements 125, the first symmetrical micro-strip line 130 and the first balun 140 are disposed on the front surface 112 of the dielectric substrate 110, while the second low frequency antenna elements 150, the second high frequency antenna elements 155, the second symmetrical micro-strip line 160 and the second balun 170 are disposed on the rear surface 114 of the dielectric substrate 110. The first low frequency antenna elements 120, the first high frequency antenna elements 125, the first symmetrical micro-strip line 130 and the first balun 140 are obtained from, for example, patternizing a conductor layer (not shown) symmetrical disposed on the front surface 112 of the dielectric substrate 110, while the second low frequency antenna elements 150, the second high frequency antenna elements 155, the second symmetrical micro-strip line 160 and the second balun 170 can also be obtained from, for example, patternizing a conductor layer (not shown) symmetrical disposed on the rear surface 114 of the dielectric substrate 110. The aforementioned conductor layer, for example, can be a copper foil that is usually adopted for making ordinary printed circuit board or any other proper materials.

Referring to FIG. 1A, two ends of the first symmetrical micro-strip line 130 are respectively connected to the two first low frequency antenna elements 120. The two first high frequency antenna elements 125 are disposed between two first low frequency antenna elements 120 and connected to the first symmetrical micro-strip line 130. An end of the First balun 140 is connected to a middle segment of the first symmetric micro-strip line 130, and another end of the first balun 140 is for connecting with an antenna feeding port (not shown). In other words, the first symmetrical micro-strip line 130 is connected in sequence to one first low frequency antenna element 120, one first high frequency antenna element 125, the first balun 140, the other first high frequency antenna element 125 and the other first low frequency antenna element 120. The first balun 140 and the two first high frequency antenna elements 125 are disposed at one side of the first symmetrical micro-strip line 130 on the front surface, while the two first low frequency antenna elements 120 are disposed at the other side of the first symmetrical micro-strip line 1 30 on the front surface.

Referring to FIG. 1B, two ends of the second symmetrical micro-strip line 160 are respectively connected to two second low frequency antenna elements 150. The two second high frequency antenna elements 155 are disposed between two second low frequency antenna elements 150 and connected to the second symmetrical micro-strip line 160. An end of the second balun 170 is connected to a middle segment of the second symmetric micro-strip line 160, and another end of the second balun 170 is for connecting with an antenna feeding port (not shown). In other words, the second symmetrical micro-strip line 160 connects in sequence to a second low frequency antenna element 150, a second high frequency antenna element 155, the second balun 170, the other second high frequency antenna element 155 and the other second low frequency antenna element 150. The second balun 170 and the two second low frequency antenna elements 150 are disposed at one side of the second symmetrical micro-strip line 160, while the two second high frequency antenna elements 155 are disposed at the other side of the second symmetrical micro-strip line 160.

Therefore, the dual-frequency directional antenna 100 according to the embodiment including high frequency antenna elements and low frequency antenna elements can receive and emit signals in two frequencies.

Furthermore, again referring to FIGS. 1A and 1B, the widths of the first high frequency antenna elements 125 can be gradually broadened from one side connecting with the first symmetrical micro-strip line 130 toward outside. For example, suppose the first symmetrical micro-strip line 130 extends at the X direction, the widths of the first high frequency antenna elements 125 are gradually broadened from the connection with the first symmetrical micro-strip line 130 toward the negative Y direction. Because of the feature of that the widths of the First high frequency antenna elements 125 are gradually broadened, the dual-frequency directional antenna 100 can obtain a broadened operation frequency bandwidth at the high frequency band. Similarly, the first low frequency antenna elements 120, the second low frequency antenna elements 150 and the second high frequency antenna elements 155 can also adopt such a design for broadening the operation frequency bandwidth of the dual-frequency directional antenna 100 at both the high frequency band and the low frequency band.

Moreover, the first low frequency antenna elements 120, the first high frequency antenna elements 125, the second low frequency antenna elements 150 and the second high frequency antenna elements 155 can respectively be polygon-shaped or have any other regular or irregular shapes. For example, the first high frequency antenna elements 125 and the second high frequency antenna elements 155 according to the embodiment are pentagon-shaped. Further, the first symmetrical micro-strip line 130, for example, can be connected to an acme of the first high frequency antenna element 125. The first low frequency antenna elements 120, the first high frequency antenna elements 125, the second low frequency antenna elements 150 and the second high frequency antenna elements 155 can also adopt a design of strip shape. For instance, the first low frequency antenna elements 120 and the second low frequency antenna elements 150 according to the embodiment are designed to be strip-shaped.

Furthermore, any possible problem on signal matching can be solved by extending a first matching zone 131 from the middle segment of the first symmetrical micro-strip line 130 along with the negative Y direction and extending a second matching zone 161 from the middle segment of the second symmetrical micro-strip line 160 along with the Y direction. Herein, an end of the first balun 140 is connected with an end of the first matching zone 131 of the middle segment of the first symmetrical micro-strip line 130, while a end of the second balun 170 is connected with a end of the second matching zone 161 of the middle segment of the second symmetrical micro-strip line 160.

According to an embodiment of the invention, a distance between the two first high frequency antenna elements 125 and a distance between the two second high frequency antenna elements 155 are preferred to be about 0.3 times of a wavelength of the received and emitted high frequency signals. A distance between the two first low frequency antenna elements 120 and a distance between the two second low frequency antenna elements 150 are preferred and slightly greater than 0.3 times of a wavelength of the received and emitted low frequency signals.

Also, the width of the first balun 140 can be gradually broadened from the side connecting with the first symmetrical micro-strip line 130 toward outside as shown in FIG. 1A. Generally speaking, the broader end of the balun 140 is to be connected to a cathode of the antenna feeding port; the end, which is away from the second symmetrical micro-strip line 160 of the second balun 170, is to be connected to an anode of the antenna feeding port.

In this embodiment, the first balun 140 and the second balun 170 are disposed at equivalent corresponding positions of the dielectric substrate 110. Similarly, the first symmetrical micro-strip line 130 and the second symmetrical micro-strip line 160 are disposed at equivalent corresponding positions of the dielectric substrate 110.

Referring to FIGS. 1A and 1B again, the present invention provides a method for adjusting the ratio of the high/low frequency received by or emitted from the foregoing dual-frequency directional antenna. The method is adapted for a dual-frequency directional antenna. The method is adjusting the linewidths of the first symmetrical micro-strip line 130 and/or the second symmetrical micro-strip line 160. In details, that is adjusting the linewidth of the part 132 of the first symmetrical micro-strip line 130 between the first low frequency antenna element 120 and the first high frequency antenna element 125; adjusting the linewidth of the part 162 of the second symmetrical micro-strip line 160 between the second low frequency antenna element 150 and the second high frequency antenna element 155. As the size of the first low frequency antenna elements 120, the size of the second low frequency antenna elements 150, size of the first high frequency antenna elements 125 and the size of the second high frequency antenna elements 155 are restricted, the foregoing method can be employed for adaptively adjusting the frequency ratio between the high frequency signals and the low frequency signals received and emitted thereby.

Figure 2:
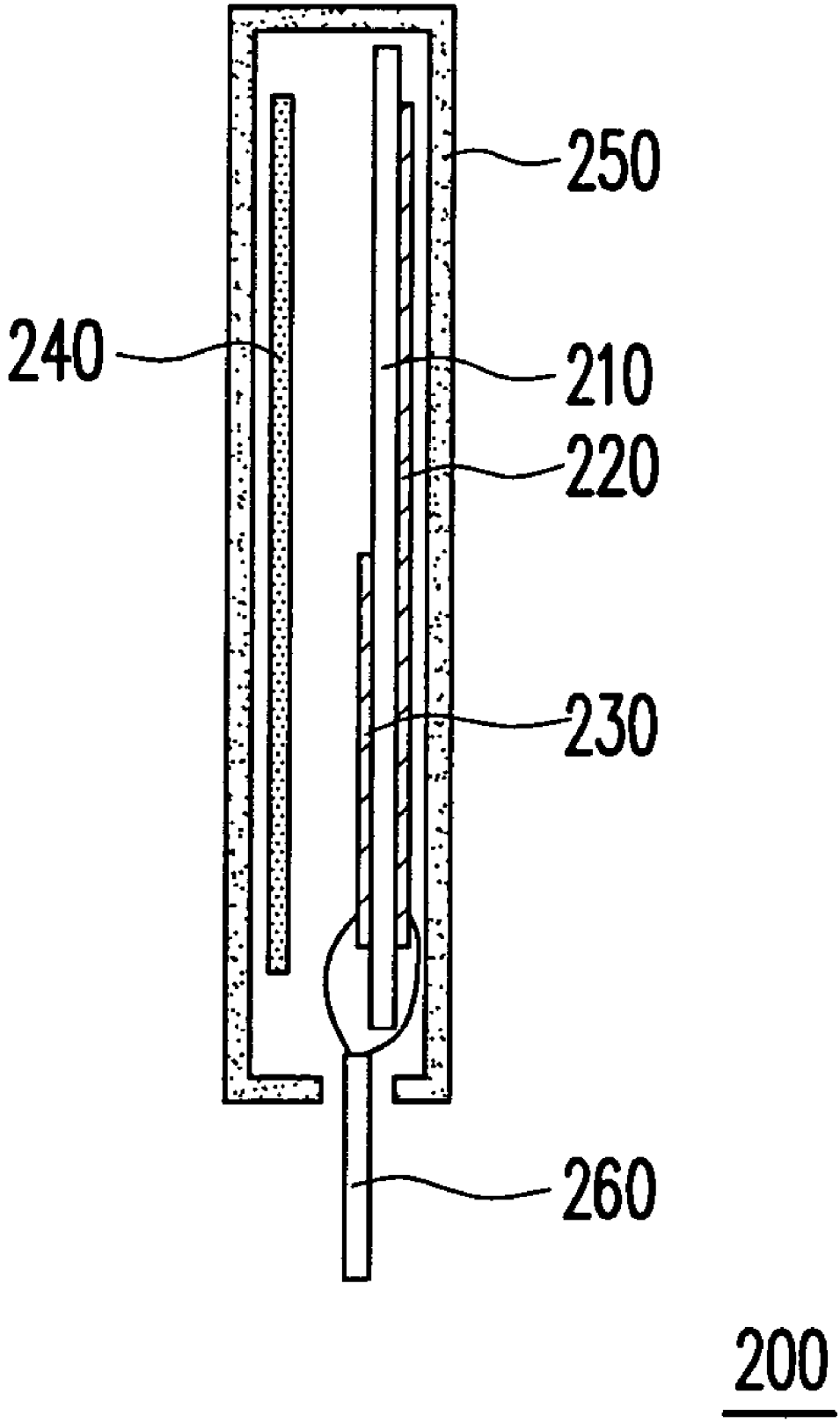
FIG. 2 is a cross-sectional side view of a dual-frequency directional antenna according to another embodiment of the invention.

FIG. 2 is a cross-sectional side view of a dual-frequency directional antenna according to another embodiment of the invention. Referring to FIG. 2, in addition to two antenna patterns 220 and 230 (equivalent with the first and second low frequency antenna elements 120 and 150, the first and second high frequency antenna elements 125 and 155, the first and the second symmetrical micro-strip lines 130 and 160, and the first and the second baluns 140 and 170 of the dual-frequency directional antenna 100) respectively disposed on the front surface and the rear surface of the dielectric substrate 210, the dual-frequency directional antenna 200 further includes a reflective element 240. The reflective element 240 can be disposed over the front surface or the rear surface of the dielectric substrate 210 and kept a distance from the dielectric substrate. Furthermore, the area of the reflective element 240, for example, is smaller than the area of the dielectric substrate 210. The material of the reflective element 240, for example, is conductive material and the reflective element 240 is preferably disposed substantially parallel with the dielectric substrate 210.

Moreover, the reflective element 240 and the dielectric substrate 210, for example, are disposed in a housing 250. The antenna patterns 220 and 230 are connected with a signal line 260 via an antenna feeding port.

In view of the above, the present invention provides a dual-frequency direction antenna including a set of high frequency antenna elements and a set of low frequency antenna elements, therefore the antenna can receive and emit signals of two frequencies. Also, the dual-frequency directional antenna with thin and compact size and is applicable for indoor environment. Moreover, a larger frequency bandwidth can be obtained by adopting an antenna element whose width is gradually broadened from the side connecting with the symmetrical micro-strip line. Further, the ratio of the high/low frequency received or emitted can be adjusted by adjusting the linewidth of the part of the symmetrical micro-strip lines between the low frequency antenna elements and the high frequency antenna elements. In addition, the shapes and designs of the antenna elements are simple, difficulty on amendments of different products can be significantly reduced.

It should be noted that specific embodiments of, and examples for, the invention are described herein for illustrative purposes, various equivalent modifications are possible within the scope of the invention, as those skilled in the relevant art will recognize that modifications and adaptations of the above-described preferred embodiments of the present invention may be made to meet particular requirements. This disclosure is intended to exemplify the invention without limiting its scope. All modifications that incorporate the invention disclosed in the preferred embodiment are to be construed as coming within the scope of the appended claims or the range of equivalents to which the claims are entitled.

What is claimed is:

1. A dual-frequency directional antenna, comprising:

a dielectric substrate, having a front surface and a rear surface;

two first low frequency antenna elements, disposed on said front surface of said dielectric substrate;

a first symmetrical micro-strip line, disposed on said front surface of said dielectric substrate, the two ends of said first symmetrical micro-strip line being respectively connected with said first low frequency antenna elements;

two first high frequency antenna elements, disposed on said front surface of said dielectric substrate and between said two first low frequency antenna elements, said two first high frequency antenna elements being connected with said first symmetrical micro-strip line;

a first balun, disposed on said front surface of said dielectric substrate and between said two first high frequency antenna elements, one end of said first balun being connected to a middle segment of said first symmetrical micro-strip line and the other end of said first balun being connected to an antenna feeding port, wherein said first balun and said first high frequency antenna elements are disposed at one side of said first symmetrical micro-strip line, and said first low frequency antenna elements are disposed at the other side of said first symmetrical micro-strip line;

two second low frequency antenna elements, disposed on said rear surface of said dielectric substrate;

a second symmetrical micro-strip line, disposed on said rear surface of said dielectric substrate, the two ends of said second symmetrical micro-strip line being respectively connected with said second low frequency antenna elements;

two second high frequency antenna elements, disposed on said rear surface of said dielectric substrate and between said two second low frequency antenna elements, said two second high frequency antenna elements being connected with said second symmetrical micro-strip line; and a second balun, disposed on said rear surface of said dielectric substrate and between said two second high frequency antenna elements, one end of said second balun being connected to a middle segment of said second symmetrical micro-strip line and the other end of said second balun being connected to an antenna feeding port, wherein said second balun and said second low frequency antenna elements are disposed at one side of said second symmetrical micro-strip line, and said second high frequency antenna elements are disposed at the other side of said second symmetrical micro-strip line.

2. The dual-frequency directional antenna according to claim 1, wherein the widths of said first high frequency antenna elements are gradually broadened from the side connecting with said first symmetrical micro-strip line toward outside.

3. The dual-frequency directional antenna according to claim 1, wherein the widths of said second high frequency antenna elements are gradually broadened from the side connecting with said second symmetrical micro-strip line toward outside.

4. The dual-frequency directional antenna according to claim 1, wherein the widths of said first low frequency antenna elements are gradually broadened from the side connecting with said first symmetrical micro-strip line toward outside.

5. The dual-frequency directional antenna according to claim 1, wherein the widths of said second low frequency antenna elements are gradually broadened from the side connecting with said second symmetrical micro-strip line toward outside.

6. The dual-frequency directional antenna according to claim 1, wherein said first high frequency antenna elements are polygon-shaped.

7. The dual-frequency directional antenna according to claim 6, wherein said first symmetrical micro-strip line is connected to an acme of said first high frequency antenna elements.

8. The dual-frequency directional antenna according to claim 1, wherein said second high frequency antenna elements are polygon-shaped.

9. The dual-frequency directional antenna according to claim 8, wherein said second symmetrical micro-strip line is connected to an acme of said second high frequency antenna elements.

10. The dual-frequency directional antenna according to claim 1, wherein said first low frequency antenna elements and said second low frequency antenna elements are strip-shaped.

11. The dual-frequency directional antenna according to claim 1, wherein the distance between said two first high frequency antenna elements is substantially equal to 0.3 times of the wavelength of high frequency signals received/emitted thereby.

12. The dual-frequency directional antenna according to claim 1, wherein the distance between said two second high frequency antenna elements is substantially equal to 0.3 times of the wavelength of high frequency signals received/emitted thereby.

13. The dual-frequency directional antenna according to claim 1, wherein the distance between said two first low frequency antenna elements is greater than 0.3 times of the wavelength of low frequency signals received/emitted thereby.

14. The dual-frequency directional antenna according to claim 1, wherein the distance between said two second low frequency antenna elements is greater than 0.3 times of the wavelength of low frequency signals received/emitted thereby.

15. The dual-frequency directional antenna according to claim 1, wherein the width of said first balun is gradually broadened from the side connecting with the said first symmetrical micro-strip line toward outside.

16. The dual-frequency directional antenna according to claim 1, wherein said first balun and said second balun are disposed at equivalent corresponding positions of said dielectric substrate.

17. The dual-frequency directional antenna according to claim 1, wherein said first symmetrical micro-strip line and said second symmetrical micro-strip are disposed at equivalent corresponding positions of said dielectric substrate.

18. The dual-frequency directional antenna according to claim 1, further comprising a reflective element, disposed over the front surface or the rear surface of said dielectric substrate and kept away from said dielectric substrate for a certain distance.

19. The dual-frequency directional antenna according to claim 18, wherein the area of said reflective element is smaller than the area of the dielectric substrate.

20. A method for adjusting a ratio of high/low frequency received by or emitted from the dual-frequency directional antenna according to claim 1, comprising:

adjusting the linewidth of the part of said first symmetrical micro-strip line between said first low frequency antenna elements and said first high frequency antenna elements; and adjusting the linewidth of the part of said second symmetrical micro-strip line between said second low frequency antenna elements and said second high frequency antenna elements.

* * * * *